US006889722B2

(12) United States Patent
Huss

(10) Patent No.: US 6,889,722 B2
(45) Date of Patent: May 10, 2005

(54) METHOD OF DISPENSING PARTICLES, A PARTICLE FILLING LINE, AND APPARATUS FOR DISPENSING PARTICLES

(75) Inventor: Timothy L. Huss, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 108 days.

(21) Appl. No.: 10/383,348

(22) Filed: Mar. 6, 2003

(65) Prior Publication Data

US 2004/0173280 A1 Sep. 9, 2004

(51) Int. Cl.[7] ..... B65B 31/00

(52) U.S. Cl. ..... 141/8; 141/65; 141/67; 141/72; 222/152; 222/190

(58) Field of Search ..... 141/8, 12, 67, 141/65, 71, 72, 73, 255, 256; 222/152, 190

(56) References Cited

U.S. PATENT DOCUMENTS 2,142,990 A * 1/1939 Belcher ..... 141/256
3,269,611 A * 8/1966 Komarek ..... 222/190
3,543,970 A * 12/1970 Buchner ..... 222/190
4,125,208 A * 11/1978 Bettermann ..... 222/152
4,457,125 A * 7/1984 Fishburne ..... 141/80
6,021,821 A 2/2000 Wegman ..... 141/93
6,056,025 A 5/2000 Wegman ..... 141/67
6,196,278 B1 3/2001 Wegman et al. ..... 141/65
6,347,648 B1 2/2002 Wegman et al. ..... 141/1
6,484,764 B1 11/2002 Wegman et al. ..... 141/286
6,497,259 B1 12/2002 Wegman ..... 141/267
6,527,141 B2 * 3/2003 Sanders ..... 222/152

* cited by examiner

*Primary Examiner*—Gregory L. Huson
*Assistant Examiner*—Khoa D. Huynh
(74) *Attorney, Agent, or Firm*—Wayne J. Egan

(57) ABSTRACT

A particle filling line comprises a vertical conduit that is arranged to dispense particles to one or more containers that are disposed on an included movable conveyor belt. The conduit includes a conduit hollow, a conduit top and a conduit bottom that defines an outlet. Particles supplied to the conduit top flow through the outlet to fill the containers. The conduit is filled with particles. The particles include a particle spacing air. The particle spacing air is reduced by means of a porous tube that is fixed in the conduit hollow and coupled to a vacuum source. After reducing the particle spacing air, the particles flow through the outlet to be received in the containers.

22 Claims, 3 Drawing Sheets

METHOD OF DISPENSING PARTICLES, A PARTICLE FILLING LINE, AND APPARATUS FOR DISPENSING PARTICLES

INCORPORATION BY REFERENCE OF OTHER U.S. PATENTS

The applicant hereby incorporates by reference the disclosures of the following U.S. patents verbatim and with the same effect as though all such disclosures were fully and completely set forth herein:

U.S. Pat. No. 6,021,821 to Paul M. Wegman, entitled "Particulate processing apparatus", granted 8 Feb. 2000, hereinafter referred to as the "Wegman '821 patent";

U.S. Pat. No. 6,056,025 to Paul M. Wegman, entitled "High speed air nozzle for particulate filling system", granted 2 May 2000, hereinafter referred to as the "Wegman '025 patent";

U.S. Pat. No. 6,196,278 to Paul M. Wegman et al., entitled "Powder filling utilizing vibrofluidization", granted 6 Mar. 2001, hereinafter referred to as the "Wegman '278 patent";

U.S. Pat. No. 6,484,764 to Paul M. Wegman et al., entitled "Filling apparatus having an even-filling nozzle", granted 26 Nov. 2002, hereinafter referred to as the "Wegman '764 patent"; and U.S. Pat. No. 6,497,259 to Paul M. Wegman, entitled "Filling apparatus", granted 8 Feb. 2000, hereinafter referred to as the "Wegman '259 patent".

BACKGROUND OF THE INVENTION

For many larger toner cartridges the filling rates are limited by the stability of toner replenishment to the filler hopper. When toner is passed through the toner filling line too fast the toner becomes fluid and causes problems such as over-filled cartridges, poor weight control, and free flow.

It is known to increase toner density by decreasing the amount of particle spacing air between the toner particles. As a result, currently filler hoppers are supplied by large bins in efforts to give the toner a long resident time in the bin so it will be delivered to the toner filling line with the toner density being increased. The increased toner density is equivalent to a reduced amount of particle spacing air between the toner particles.

Other methods to maintain delivery of dense toner to the toner filling line include utilizing various valves, vents, vibrators and mechanical agitators.

DETAILED DESCRIPTION OF THE INVENTION

Briefly, a particle filling line comprises a vertical conduit that is arranged to dispense particles to one or more containers that are disposed on an included movable conveyor belt. The conduit includes a conduit hollow, a conduit top and a conduit bottom that defines an outlet. Particles supplied to the conduit top flow through the outlet to fill the containers. The conduit is filled with particles. The particles include a particle spacing air. The particle spacing air is reduced by means of a porous tube that is fixed in the conduit hollow and coupled to a vacuum source. After reducing the particle spacing air, the particles flow through the outlet to be received in the containers. In one embodiment, the porous tube is substantially horizontally-oriented. In one embodiment, the porous tube forms a toroid-shaped ring.

Figure 1:
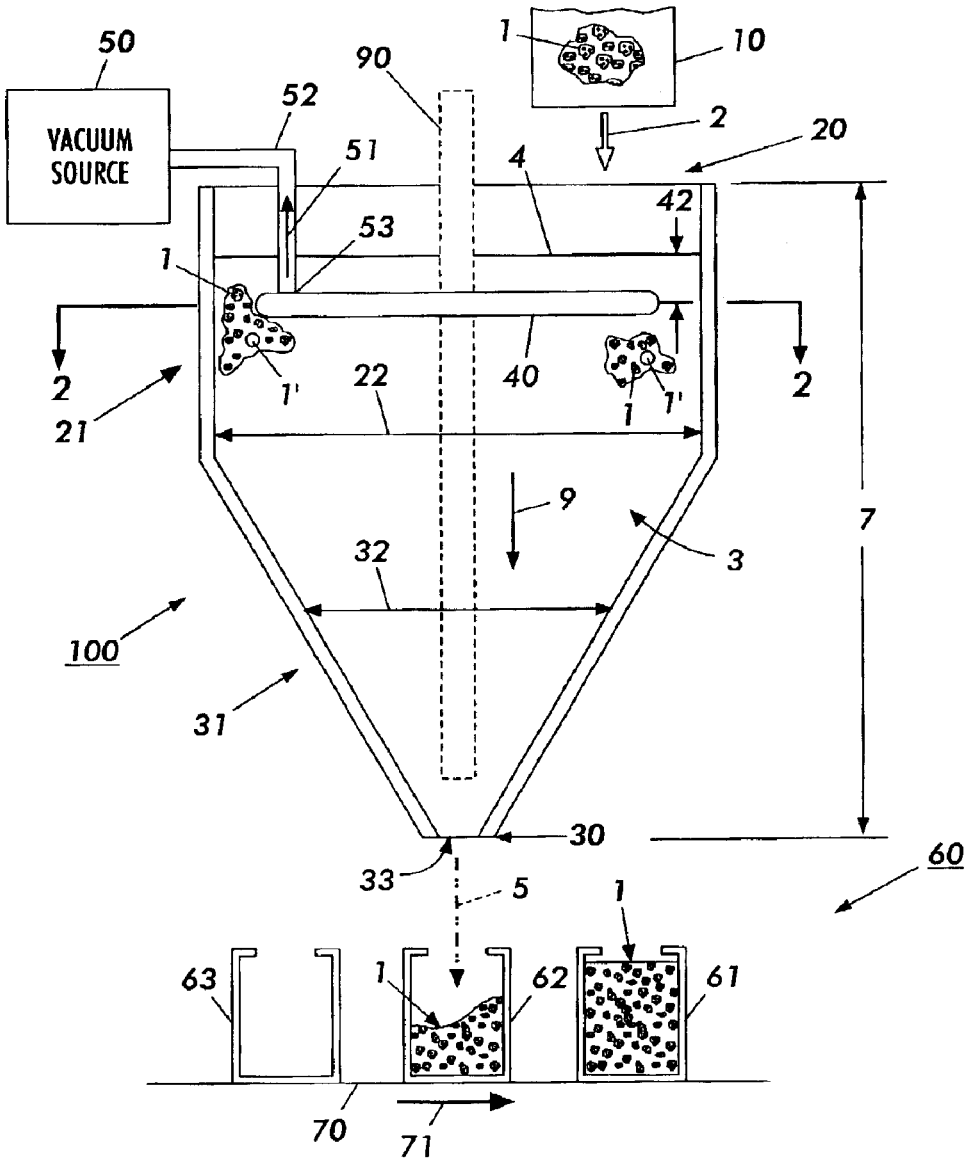
FIG. 1 is a cutaway, cross-section view of a particle filling line comprising a vertically-oriented conduit 100 arranged with one or more containers 61, 62 and 63 that are disposed on an included movable conveyor belt 70. The one or more containers 61, 62 and 63 are collectively depicted by the reference number 60. The conduit 100 includes a conduit hollow 3, a conduit top 20 and a conduit bottom 30 that defines an outlet 33. The conduit 100 is arranged so that particles 1 supplied to the conduit top 20 ultimately flow through the outlet 33 to be dispensed in the one or more containers 60. The particle filling line includes a vacuum source 50.

Referring to FIG. 1, there is shown a particle filling line comprising a vertically-oriented conduit 100. The conduit 100 includes a conduit hollow 3, a conduit top 20 and a conduit bottom 30, with a conduit height 7 between the conduit top 20 and the conduit bottom 30. The conduit bottom 30 defines an outlet 33. A particle source 10 is arranged to supply particles 1 to the conduit top 20. Particles 1 being supplied to the conduit 100 are depicted by the reference number 2. Thus supplied to the conduit 100, the particles 1 thereafter flow in a downward particle flow direction 9 to the conduit bottom 30 to then be dispensed through the outlet 33. Particles being dispensed from the conduit 100 are depicted by the reference number 5. As depicted, the particle filling line is arranged to fill one or more containers 60 with particles 1.

As shown in FIG. 1, the conduit 100 comprises a cylindrical-shaped portion 21 proximate to the conduit top 20, with a corresponding cylindrical portion inner diameter 22 that is uniform along the height 7 in the particle flow direction 9. Also, the conduit 100 further comprises a conical-shaped portion 31 proximate to the conduit bottom 30 with a corresponding cylindrical portion inner diameter 32 that becomes increasingly narrower along the height 7 in the particle flow direction 9.

In one embodiment, the conduit 100 includes a vertically-oriented particle conveyor 90 (shown in broken lines) disposed at least partly in the conduit hollow 3.

Figure 2:
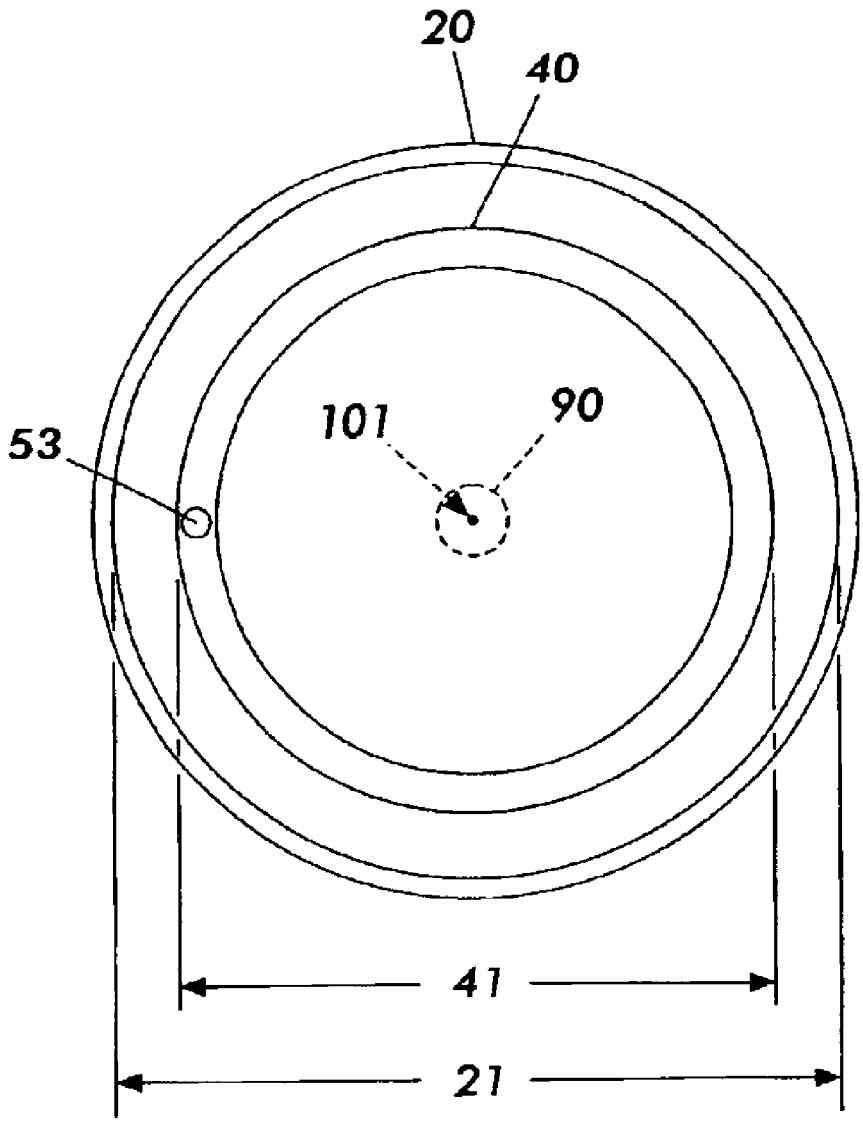
FIG. 2 is a birds-eye view of the FIG. 1 conduit 100 based on the FIG. 1 reference line designated 2—2, wherein the conduit 100 vertical axis is depicted as reference number 101.

Referring now to FIG. 2, in one embodiment, the particle conveyor 90 is substantially centered with the conduit vertical axis 101.

Returning to FIG. 1, the operation of the depicted particle filling line is now described. First, the conduit hollow 3 is filled 2 with particles 1 to a particle supply level 4, the particles in the conduit hollow 3 below the particle supply level 4 including a particle spacing air 1'. The particle spacing air 1' is then reduced. After reducing the particle spacing air 1', the particles 1 flow 5 through the outlet 33 to be received in one or more containers 60 disposed on an included conveyor belt 70 that is arranged to move in a direction 71.

As shown in FIG. 1, the particle spacing air 1' is reduced by a porous tube 40 that is fixed in the conduit hollow 3. The porous tube 40 has a substantially horizontal orientation. The filling 2 of the conduit hollow 3 with particles 1 results in the particles 1 substantially surrounding the porous tube 4. The particle supply level 4 is above the porous tube 40 by a height difference depicted in FIG. 1 by reference number 42.

As depicted in FIG. 1, the porous tube 40 is coupled to a vacuum source 50 by means of a vacuum feed line 52. The flow of particle spacing air 1' from the conduit 100 to the vacuum source 50 is depicted by reference number 51. In one embodiment, the vacuum source 50 applies a vacuum pressure of about 3 pounds per square inch, which pressure is equivalent to 6 inches of Mercury, or 0.2 Bars.

Referring now to FIG. 2, in one embodiment, the porous tube 40 forms a toroid-shaped ring that surrounds the particle conveyor 90. In one embodiment, the toroid-shaped porous tube 40 is substantially centered with the conduit vertical axis 101.

Figure 3:
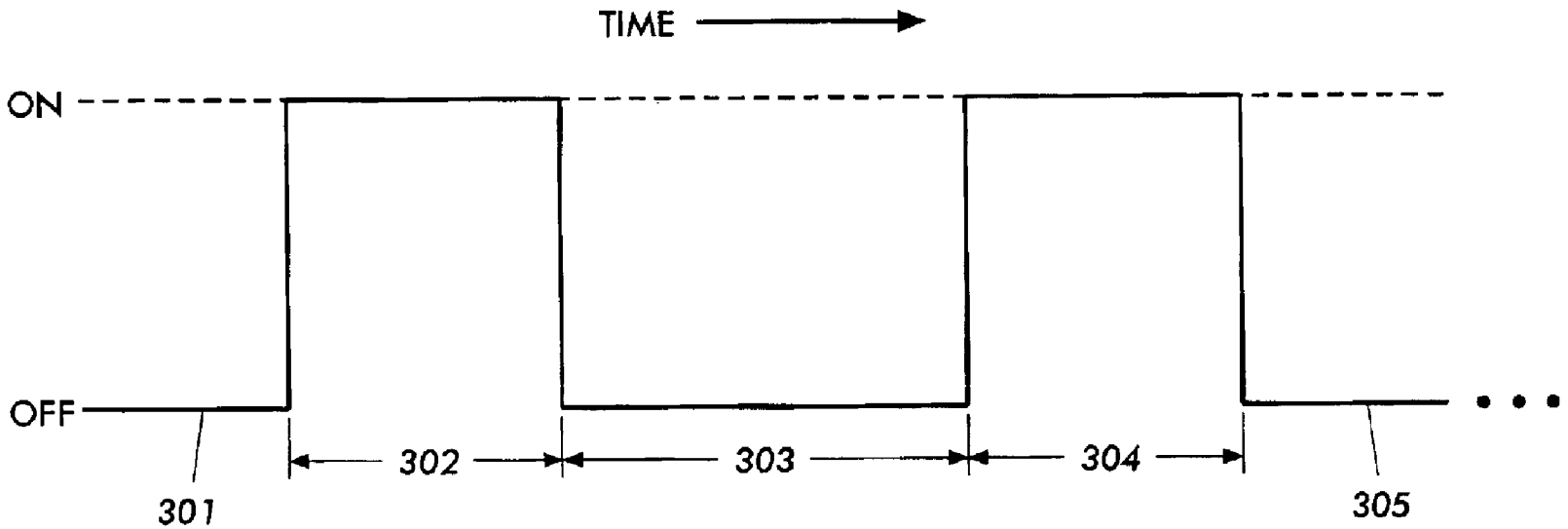
FIG. 3 is a first embodiment of a timing diagram of the "ON" and "OFF" states of the FIG. 1 vacuum source 50.

Referring now to FIG. 3, in one embodiment, the vacuum pressure 50 is applied to the porous tube for at least a fixed period 302 such as, for example, about 5 seconds, with the one or more containers 60 being filled during the successive period 303.

Returning again to FIG. 1, in one embodiment, the porous tube 40 is fixed in the hollow 3 by being suspended by vertically-oriented support wires (not shown) from above the conduit top 20.

In one embodiment, the porous tube 40 is supported by the vertical vacuum feed line 52 and two (2) included two millimeter (2 mm) outer diameter stainless steel weld support wires. Each support wire is spaced an equal radial distance from the juncture 53 of the porous tube 40 and the vacuum feed line 52. Thus, with respect to the conduit vertical axis 101, each support wire is radially spaced one hundred twenty (120) degrees from the juncture 53. Each support wire has one end wrapped tightly several times around the porous tube 40 outer diameter with the opposite end brought through a tapped hole in the conduit top 20 to hold the support wire.

In one embodiment, the vacuum feed line 52 connects to an end-to-end quick connect externally threaded push fitting secured to the conduit top 20 by two (2) nuts and two (2) gaskets to seal each side.

Still referring to FIG. 1, in one embodiment, the porous tubing material is obtained from its supplier in a standard thirty-six inch (36") linear length. Thus, to prepare the tubing for installation into the conduit 100, the tubing is bent into a circular ring shape with each tube end inserted into a one-half inch (½") T quick connect push fitting at the porous tube and vacuum feed line juncture 53. The T fitting secures the tube ends to maintain the ring shape. Also, the T fitting provides the coupling juncture 53 for the vacuum feed line 52 to thus maintain the integrity of the vacuum flow of particle spacing air 51 through the porous tube 40 and the vacuum feed line 52.

In one embodiment, the porous tube 40 comprises an ultra-high molecular weight polyethylene material. Such porous tubing materials are available from various suppliers, such suppliers including Porex Technologies, 500 Bohannon Road, Fairburn, Ga., 30312, phone number 770-964-1428, website address www.porex.com. In one embodiment, the porous tube 40 comprises an inner diameter of about ⅛-inch and an outer diameter of about ½-inch.

Still referring to the particle filling line depicted in FIG. 1, in one embodiment, the particles 1 comprise xerographic toner particles, the conduit 100 comprises a toner filler hopper, and the one or more containers 60 comprise toner cartridges.

In another embodiment, the particles 1 comprise non-toner particles.

As shown in FIG. 1, in one embodiment, the conduit height 7 is about 28 inches and the particle supply level 4 and porous tube 40 height difference 42 is from 1 to 3 inches.

As shown in FIG. 2, in one embodiment, the conduit cylindrical portion inner diameter 22 is about 22 inches and the porous tube 40 outer diameter 41 is about 12 inches.

Referring generally to FIGS. 1–3, in one embodiment, the conduit 100 is similar or identical to any of the following apparatus counterparts: the hopper 12 in the Wegman '821 patent; the powder filling assisting apparatus 10 in the Wegman '025 patent; the hopper 12 in the Wegman '278 patent; the hopper 14 in the Wegman '764 patent; and the hopper 14 in the Wegman '259 patent.

In one embodiment, the particle conveyor 90 is similar or identical to any of the following apparatus counterparts: the screw auger 22 in the Wegman '821 patent; the spiral conveyor or auger 40 in the Wegman '025 patent; the auger 104 in the Wegman '278 patent; the spiral conveyor or auger 40 in the Wegman '764 patent; and the spiral conveyor or auger 40 in the Wegman '259 patent.

In one embodiment, the one or more containers 60 are similar or identical to any of the following apparatus counterparts: the toner bottle 36 described at col. 9, lines 13–14 in the Wegman '821 patent; the container 16 in the Wegman '025 patent; the container 116 in the Wegman '278 patent; the container 116 in the Wegman '764 patent; and the container 16 in the Wegman '259 patent.

In one embodiment, the conveyor belt 70 is similar or identical to any of the following apparatus counterparts: the conveyor 142 in the Wegman '821 patent; the indexing conveyor 170 in the Wegman '025 patent; and the conveyor 170 in the Wegman '278 patent.

The table below lists the drawing FIGS. 1–3 element reference numbers together with their corresponding written description:

| Reference number: | Description: |
|---|---|
| 1 | particles |
| 1' | particle spacing air |
| 2 | particles being supplied to the conduit |
| 3 | conduit hollow |
| 4 | particle supply level |
| 5 | particles being dispensed from the conduit |
| 7 | conduit height |
| 9 | flow of particles in conduit |
| 10 | particle source |
| 20 | conduit top |
| 21 | conduit cylindrical portion |
| 22 | conduit cylindrical portion inner diameter |
| 30 | conduit bottom |
| 31 | conduit conical portion |
| 32 | conduit conical portion inner diameter |
| 33 | conduit outlet |
| 40 | porous tube |
| 41 | porous tube toroid-shaped ring outer diameter |
| 42 | particle supply level and porous tube height difference |
| 50 | vacuum source |
| 51 | flow of particle spacing air |
| 52 | vacuum feed line |
| 53 | porous tube and vacuum feed line juncture |
| 60, 61, 62, 63 | containers |
| 70 | conveyor belt |
| 71 | direction of conveyor belt |
| 90 | particle conveyor |
| 100 | conduit |
| 101 | conduit vertical axis |
| 301, 302, 303, 304, 305 | time periods |

Thus, there has been described a method of dispensing 5 particles 1 utilizing apparatus depicted in FIG. 1 comprising a vertically-oriented conduit 100 having a conduit hollow 3, a conduit top 20 and a conduit bottom 30, the conduit bottom 30 defining an outlet 33, the conduit 100 arranged so that particles 1 supplied to the conduit top 20 flow through the outlet 33, the method comprising (a) filling 2 the conduit hollow 3 with particles 1, the particles 1 including a particle spacing air 1'; (b) reducing the particle spacing air 1' (based on the flow 51 of particle spacing air 1'); and (c) flowing 5 the particles 1 through the outlet 33.

Also, there has been described a container depicted in FIG. 1 by the reference number 62 that has been at least partly filled with particles 1 in accordance with a method. The method utilizes apparatus depicted in FIG. 1 comprising a vertically-oriented conduit 100 having a conduit hollow 3, a conduit top 20 and a conduit bottom 30, the conduit bottom 30 defining an outlet 33, the conduit 100 arranged so that particles 1 supplied to the conduit top 20 flow through the outlet 33, the method comprising (a) filling 2 the conduit hollow 3 with particles 1, the particles 1 including a particle spacing air 1'; (b) reducing the particle spacing air 1' (based on the flow 51 of particle spacing air 1'); and (c) flowing 5 the particles 1 through the outlet 33 to be received in the container 62.

Further, there has been described a particle filling line depicted in FIG. 1 comprising a vertically-oriented conduit 100, the conduit 100 having a conduit hollow 3, a conduit top 20 and a conduit bottom 30, the conduit bottom 30 defining an outlet 33, the conduit 100 arranged so that particles 1 supplied to the conduit top 20 flow through the outlet 33, the particle filling line arranged to fill one or more containers with particles 1 in accordance with a method comprising (a) filling 2 the conduit hollow 3 with particles 1, the particles 1 including a particle spacing air 1'; (b) reducing the particle spacing air 1' (based on the flow 51 of particle spacing air 1'); and (c) flowing the particles 1 through the outlet 33 to be received 5 in one or more containers 60 disposed on an included movable conveyor belt 70.

Also, there has been depicted a method of dispensing particles 1 utilizing apparatus depicted in FIG. 1 comprising a vertically-oriented conduit 100 having a conduit hollow 3, a conduit top 20 and a conduit bottom 30, the conduit bottom 30 defining an outlet 33, the conduit 100 arranged so that particles 1 supplied to the conduit top 20 flow through the outlet 33, a porous tube 40 substantially horizontally-oriented in the conduit hollow 3, the method comprising (a) filling 2 the conduit hollow 3 with particles 1 so that particles 1 substantially surround the porous tube 40; (b) applying a vacuum pressure 50 to the porous tube 40; and (c) flowing 5 the particles 1 through the outlet 33.

Further, there has been described a container depicted in FIG. 1 by the reference number 62 that has been at least partly filled with particles 1 in accordance with a method. The method utilizes apparatus depicted in FIG. 1 comprising a vertically-oriented conduit 100 having a conduit hollow 3, a conduit top 20 and a conduit bottom 30, the conduit bottom 30 defining an outlet 33, the conduit 100 arranged so that particles 1 supplied to the conduit top 20 flow through the outlet 33, a porous tube 40 substantially horizontally-oriented in the conduit hollow 3, the method comprising (a) filling 2 the conduit hollow 3 with particles 1 so that particles 1 substantially surround the porous tube 40; (b) applying a vacuum pressure 50 to the porous tube 40; and (c) flowing 5 the particles 1 through the outlet 33 to be received in the container 62.

Also, there has been described a particle filling line depicted in FIG. 1 comprising a vertically-oriented conduit 100, the conduit 100 having a conduit hollow 3, a conduit top 20 and a conduit bottom 30, the conduit bottom 30 defining an outlet 33, the conduit 100 arranged so that particles 1 supplied to the conduit top 20 flow through the outlet 33, a porous tube 40 substantially horizontally-oriented in the conduit hollow 3, the particle filling line arranged to fill one or more containers with particles 1 in accordance with a method comprising (a) filling 2 the conduit hollow 3 with particles 1 so that particles 1 substantially surround the porous tube 40; (b) applying a vacuum pressure 50 to the porous tube 40; and (c) flowing the particles 1 through the outlet 33 to be received 5 in one or more containers 60 disposed on an included movable conveyor belt 70.

The present invention results in a 50–100% increase in toner filling throughput rates by enabling consistent dense toner in the toner filler hopper 100. As a result, this invention increases the capacity of existing capital toner filling equipment. The invention uses the porous tube 40 comprising Porex (it is noted the term "Porex" is a trade mark of Porex Technologies Corporation) rods connected to an alternating vacuum source 50 to increase the toner density inside the filler hopper 100. The vacuum 50 is turned on while particles 1 are being supplied 2 to the hopper 100 and off while particles 1 are being dispensed 5 to the toner cartridges 60. The small micron size of the porous tube 40 material allows air to be pulled out of the toner particles 1 below the particle supply level 4. The hollow core of the tube 40 maximizes vacuum flow to the entire surface of the tube 40. The air is pulled from the toner particles in the filler hopper 100 resulting in a dense toner state that enables accurate high-speed volumetric filling.

The Porex rods are positioned inside the upper portion of the hopper 100 to come into contact with the toner 1. The rods are attached to a vacuum source that is alternated on and off as depicted in FIG. 3.

The invention is easy and low cost to retrofit on existing toner filling equipment. By enabling consistent dense toner in the filling hopper, weight control improves, and the toner fill is denser, thus allowing more toner to fit in the container and a cleaner fill.

While various embodiments of a method of dispensing particles, a particle filling line, and apparatus for dispensing particles, in accordance with the present invention, are described above, the scope of the invention is defined by the following claims.

What is claimed is:

1. A method of dispensing particles, the method comprising providing a vertically-oriented conduit having a conduit hollow, a conduit top and a conduit bottom, the conduit bottom defining an outlet, the conduit arranged so that particles supplied to the conduit top flow through the outlet, an included porous tube being substantially horizontally-oriented within the conduit hollow, the horizontally-oriented porous tube forming a toroid-shaped ring with a corresponding toroid-shaped ring outer diameter that is positioned wholly within the conduit hollow, the method further comprising (a) filling the conduit hollow with particles so that particles substantially surround all outer surfaces of the toroid-shaped ring porous tube that is positioned within the conduit hollow; (b) applying a vacuum pressure to the porous tube; and (c) flowing the particles through the outlet to be received by one or more containers.

2. The method of claim 1, the conduit comprising a conduit cylindrical-shaped portion proximate to the conduit top, the porous tube positioned within the conduit cylindrical portion.

3. The method of claim 2, the conduit cylindrical-shaped portion having a corresponding cylindrical portion inner surface that surrounds the porous tube.

4. The method of claim 3, the particles comprising toner particles and the conduit comprising a toner filler hopper.

5. The method of claim 4, the porous tube comprised of an ultra-high molecular weight polyethylene material.

6. The method of claim 4, the vacuum pressure applied to the porous tube at a pressure of about 3 pounds per square inch.

7. A particle filling line comprising a vertically-oriented conduit, the conduit having a conduit hollow, a conduit top and a conduit bottom, the conduit bottom defining an outlet, the conduit arranged so that particles supplied to the conduit top flow through the outlet, an included porous tube being substantially horizontally-oriented within the conduit hollow, the horizontally-oriented porous tube forming a toroid-shaped ring with a corresponding toroid-shaped ring outer diameter that is positioned wholly within the conduit hollow, the particle filling line arranged to fill one or more containers with particles in accordance with a method comprising (a) filling the conduit hollow with particles so that particles substantially surround all outer surfaces of the toroid-shaped ring porous tube that is positioned within the conduit hollow; (b) applying a vacuum pressure to the porous tube; and (c) flowing the particles through the outlet to be received in one or more containers disposed on an included movable conveyor belt.

8. The particle filling line of claim 7, the conduit comprising a conduit cylindrical-shaped portion proximate to the conduit top, the porous tube positioned within the conduit cylindrical portion.

9. The particle filling line of claim 8, the porous tube comprised of an ultra-high molecular weight polyethylene material.

10. The particle filling line of claim 9, the particles comprising toner.

11. The particle filling line of claim 8, the conduit cylindrical-shaped portion having a corresponding cylindrical portion inner surface that surrounds the porous tube.

12. The particle filling line of claim 11, the porous tube comprised of an ultra-high molecular weight polyethylene material.

13. The particle filling line of claim 12, the particles comprising toner.

14. The particle filling line of claim 8, the conduit having a conduit vertical axis, the porous tube substantially centered with the conduit vertical axis.

15. Apparatus for dispensing particles comprising a vertically-oriented conduit, the conduit having a conduit hollow, a conduit top and a conduit bottom, the conduit bottom defining an outlet so that particles supplied to the conduit top flow through the outlet, an included porous tube being substantially horizontally-oriented within the conduit hollow, the horizontally-oriented porous tube forming a toroid-shaped ring with a corresponding toroid-shaped ring outer diameter that is positioned wholly within the conduit hollow so that filling the conduit hollow with particles results in particles substantially surrounding all outer surfaces of the toroid-shaped ring porous tube that is positioned within the conduit hollow; the porous tube being arranged and coupled to a vacuum source so that a vacuum pressure applied to said porous tube aids in flowing the particles through said outlet.

16. The apparatus of claim 15, the conduit comprising a conduit cylindrical-shaped portion proximate to the conduit top, the porous tube positioned within the conduit cylindrical portion.

17. The apparatus of claim 16, the porous tube comprised of an ultra-high molecular weight polyethylene material.

18. The apparatus of claim 17, the particles comprising toner.

19. The apparatus of claim 16, the conduit cylindrical-shaped portion having a corresponding cylindrical portion inner surface that surrounds the porous tube.

20. The apparatus of claim 19, the porous tube comprised of an ultra-high molecular weight polyethylene material.

21. The apparatus of claim 20, the particles comprising toner.

22. The particle filling line of claim 16, the conduit having a conduit vertical axis, the porous tube substantially centered with the conduit vertical axis.

* * * * *